US007137929B2

(12) United States Patent
Fan

(10) Patent No.: US 7,137,929 B2
(45) Date of Patent: Nov. 21, 2006

(54) FITNESS BIKE

(76) Inventor: Jeeng-Neng Fan, No. 34, Alley 10, Lane 54, Sec. 2, Yangsin Rd, Yang mei (TW)

( * ) Notice: Subject to any disclaimer, the term of this patent is extended or adjusted under 35 U.S.C. 154(b) by 0 days.

(21) Appl. No.: 11/285,036

(22) Filed: Nov. 23, 2005

(65) Prior Publication Data

US 2006/0160668 A1 Jul. 20, 2006

(30) Foreign Application Priority Data

Jan. 19, 2005 (TW) ..... 942000980 U

(51) Int. Cl.
*A63B 23/04* (2006.01)
*A63B 69/16* (2006.01)

(52) U.S. Cl. ..... 482/57; 601/30

(58) Field of Classification Search ..... 482/51, 482/57–65, 92; 601/30
See application file for complete search history.

(56) References Cited

U.S. PATENT DOCUMENTS 1,788,176 A * 1/1931 Sturtevant ..... 601/30
1,998,522 A * 4/1935 Pyles ..... 601/30
2,081,365 A * 5/1937 Mueller et al. ..... 601/30
3,024,023 A * 3/1962 Philip ..... 482/62
3,714,438 A * 1/1973 Hahn et al. ..... 398/182
4,479,646 A * 10/1984 Beistegui Chirapozu ..... 482/62
4,548,406 A * 10/1985 Beistegui Chirapozu ..... 482/62
4,561,648 A * 12/1985 Wu ..... 482/65
4,570,927 A * 2/1986 Petrofsky et al. ..... 482/60
5,643,145 A * 7/1997 Lo et al. ..... 482/57
6,027,432 A * 2/2000 Cheng ..... 482/57
6,077,201 A * 6/2000 Cheng ..... 482/57
6,217,491 B1 * 4/2001 Schiessl ..... 482/92
6,659,918 B1 * 12/2003 Schiessl ..... 482/92
6,793,609 B1 * 9/2004 Fan ..... 482/57

* cited by examiner

*Primary Examiner*—Stephen R. Crow
(74) *Attorney, Agent, or Firm*—Rosenberg, Klein & Lee

(57) ABSTRACT

This invention relates to an improved fitness bike that fixes a handle support rod and a saddle separated on both ends of a transversal rod, and the bottom of the handle support rod is pivotally coupled with and moved back and forth at a first support rod at the front end of a base, and the lower end of the saddle support rod includes a driving stand, and the upper end of a second support rod disposed at a rear end of the base installs a passive pulley, and a link rod is installed between an eccentric portion of the axle of the passive pulley and a driving stand at a lower end of the saddle support rod, and the passive pulley is driven by an active pulley on an axle of a bottom bracket shell. When an exerciser steps on the pedal, the link rod drives the lower end of the saddle support rod up and down, so that the handle support rod at another end of the transversal rod can swing back and forth by using the lower end of the fixing bolt as a pivot. The exerciser not only can train both legs, but also can achieve the effect of shaking and massaging both hands and the whole body, so as to exercise the whole body.

4 Claims, 7 Drawing Sheets

FITNESS BIKE

BACKGROUND OF THE INVENTION

1. Field of the Invention

This invention relates to an improved fitness bike, and more particularly to an improved fitness bike that comes with simple-structured and easy-to-use features, so that an exerciser can exercise both legs while achieving the effect of massaging the whole body.

2. Description of the Related Art

The construction and operation of a traditional indoor fitness bike primarily provides exercisers a direct exercise for both legs by simulating the pedaling movements of a bicycle. Of course, the fitness bike can come with a frictional resistance adjusting device, so that the exercisers can adjust the frictional force to an appropriate resistance to achieve the desired objective and effect of exercising the legs. Undeniably, the operation of a fitness bike of this kind surely has the exercising effect and objective. However, such simple operation method and exercise mode for providing the pedaling exercise is obviously monotonous and boring, and thus it is an adverse factor to the expected exercising effect.

In view of this shortcoming, manufacturers have made improvements to the fitness bike by installing the left and right handles separately and connect the left and right link rod devices separately to the left and right handles and the bottom bracket shell. When an exerciser steps on the pedal, the left and right handles swing back and forth accordingly. Besides of achieving the effect of exercising the legs, the exerciser also can stretch and bend both arms to achieve the exercise and fitness effect. Since the structure of the improved fitness bike simultaneously provides the exercises for both arms and legs, therefore it can provide a better expected exercising effect than the traditional fitness bike. However, this improved fitness bike can provide direct stretching and bending exercises for arms and legs only and still cannot provide exercises to other parts of the exerciser's body.

In view of the description above, the inventor of the present invention based on years of experience to conduct extensive researches and experiments, and finally invented the improved fitness bike in accordance with the present invention.

SUMMARY OF THE INVENTION

The primary objective of this invention is to provide an improved fitness bike, wherein a saddle support rod is driven to move vertically up and down when the exerciser steps on the pedals, and the saddle support rod is integrally coupled to a handle support rod and can swing back and forth by using the lower end of a fixing bolt as a pivot. Therefore, the exerciser not only can achieve the effect of exercising both legs, but also can exercise both arms and the whole body. With the related up-and-down and back-and-forth movements as well as the vibration of the saddle and handles, an exercise with a massaging effect is provided.

Another objective of the present invention is to provide an improved fitness bike, wherein the saddle support rod is installed and linked to a link rod on the passive pulley axle. When the exerciser leans forward to step on the pedals, the saddle will not be lifted or the handle will not be leaned forward or soared up into the air, and thus the expected effect of exercising both legs and massaging the whole body surely can be achieved.

A further objective of the present invention is to provide an improved fitness bike, wherein a rolling wheel is installed in contact separately with an eccentric portion of an axle of a passive pulley and a driving stand at the lower end of a saddle support rod, and a limit rod is installed between a base and the saddle support rod, and a buffer member is installed on the limit rod. If the exerciser uses the body weight to apply a force to the two rolling wheels and step on the pedals, the effects of exercising both legs and massaging the whole body can be achieved as well, and more particularly the buffer member assures the proper contact of the two rolling wheels to provide comforts for users.

Another further objective of the present invention is to provide an improved simple structured and easy-to-use fitness bike to achieve the effects of exercising both legs and massaging the whole body of the exerciser.

DETAILED DESCRIPTION OF THE PREFERRED EMBODIMENTS

Figure 1:
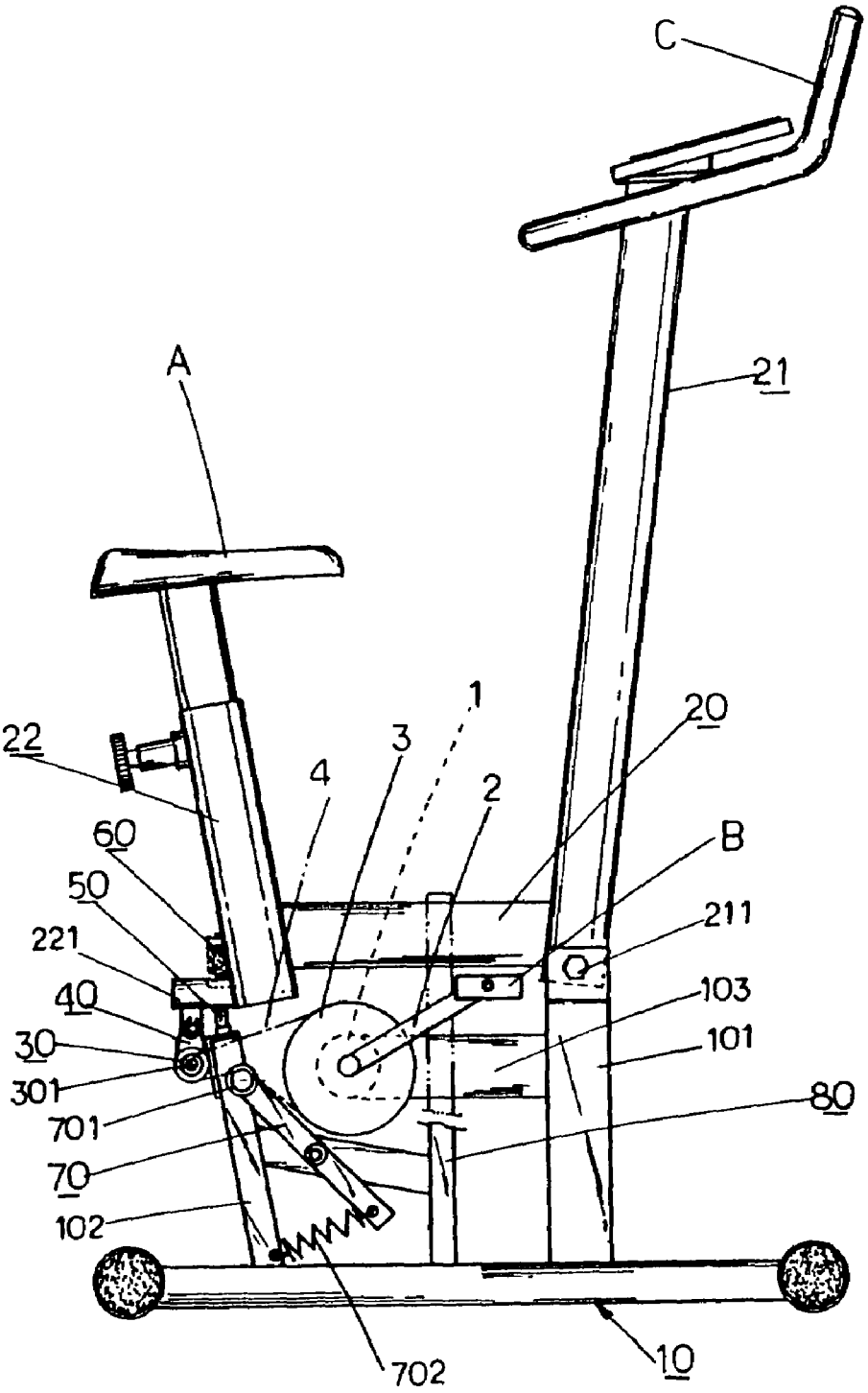
FIG. 1 is a schematic planar view of a preferred embodiment of the present invention.
Figure 2:
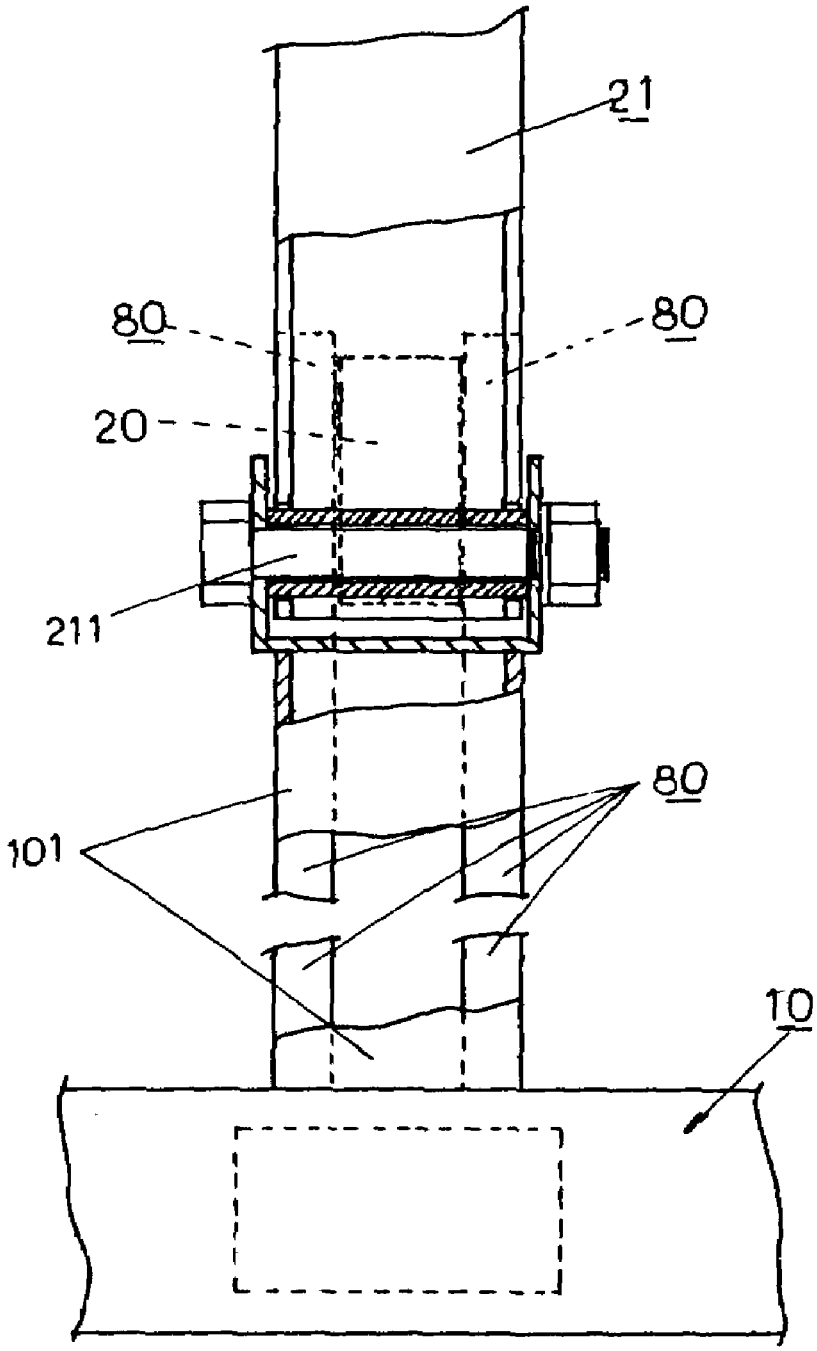
FIG. 2 is a schematic planar view of connecting a base and a handle support rod according to the present invention.
Figure 3:
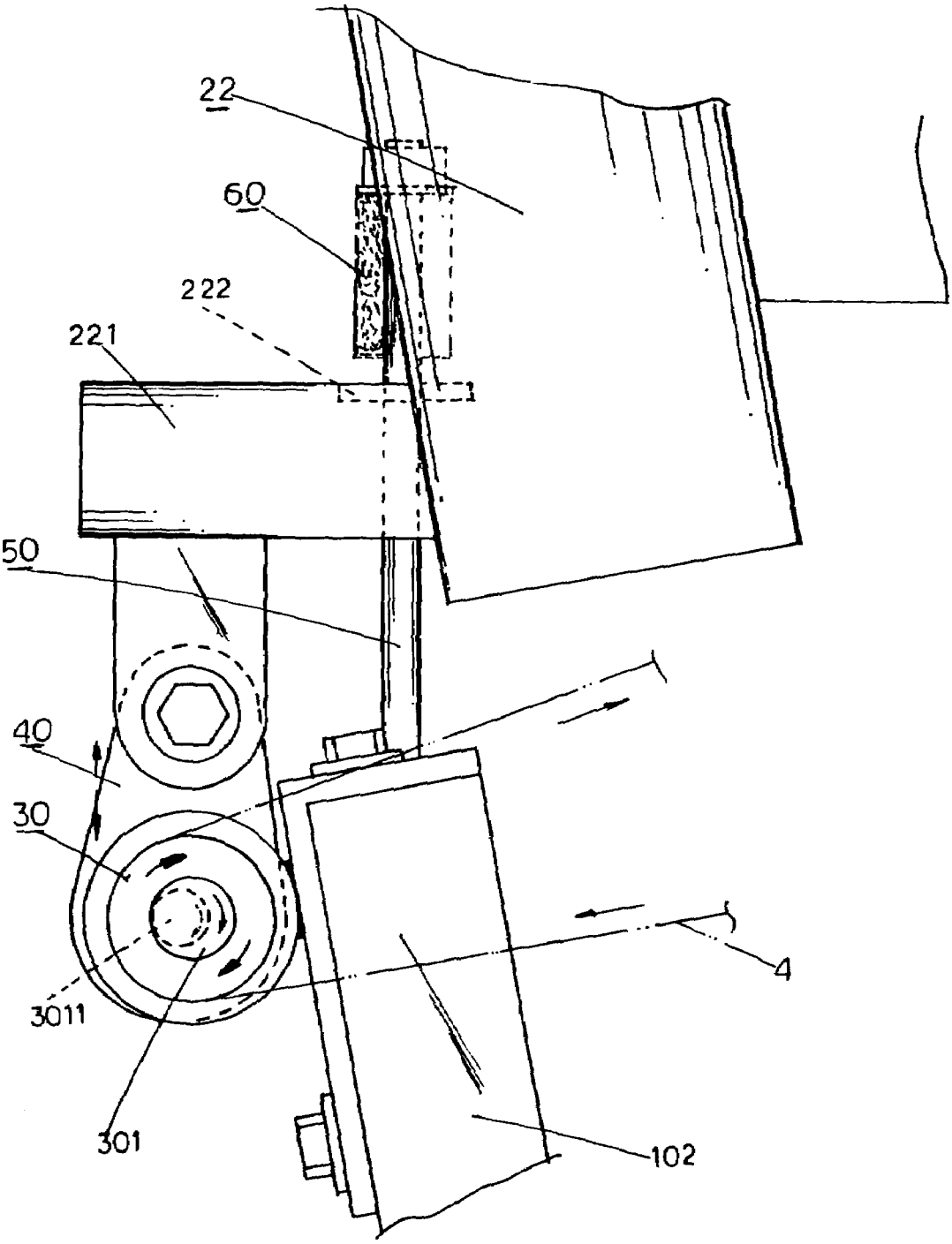
FIG. 3 is a schematic planar view of a link rod being linked to a saddle support rod and a passive pulley axle according to the present invention.

Referring to FIGS. 1 to 4, an improved fitness bike in accordance with the present invention comprises: a base 10 having a first support rod 101 disposed upward from a position proximate to the front end of the base 10, a second support rod 102 disposed upward from a position proximate to the rear end of the base 10, a bottom bracket shell 1 installed between the first support rod 101 and the second support rod 102 by a support arm 103 to fix a crank 2 and an active pulley 3; a transversal rod 20 having a handle support rod 21 fixed at the front end of the transversal rod 20 and a saddle support rod 22 fixed at the rear end of the transversal rod 20, wherein the bottom of the handle support rod 21 is pivotally coupled to and moved back and forth at the upper end of the first support rod 101 of the base 10 by a fixing bolt 211 (as shown in FIG. 2), and the lower end of the saddle support rod 22 includes a driving stand 221; a passive pulley 30 installed at the upper end of the second support rod 102 of the base 10 and driven by a transmission belt 4 of the active pulley 3, and an end of an axle 301 of the passive pulley 30 includes an eccentric portion 3011; a link rod 40 coupled between the eccentric portion 3011 of the axle 301 of the passive pulley axle 30 and the driving stand 221 of the saddle support rod 22; a limit rod 50 installed on the base 10 or the base second support rod 102 and the upper end of the limit rod 50 is passed through a fastening protrusion 222 of the saddle support rod 22 and has a buffer member 60 (such as spring or rubber); a swinging rod 70 having its middle section pivotally coupled to and swung up and down at the base 10 and an end of the swinging rod includes a tension wheel 701 being in contact with a transmission belt 4 and the other end being pulled by a resilient member 702, such that the tension wheel 701 is elastically in contact with the transmission belt 4, and two holding rods 80 are fixed on 於 base 10 and disposed at a position proximate to the left and right sides of the transversal rod 20.

Figure 4:
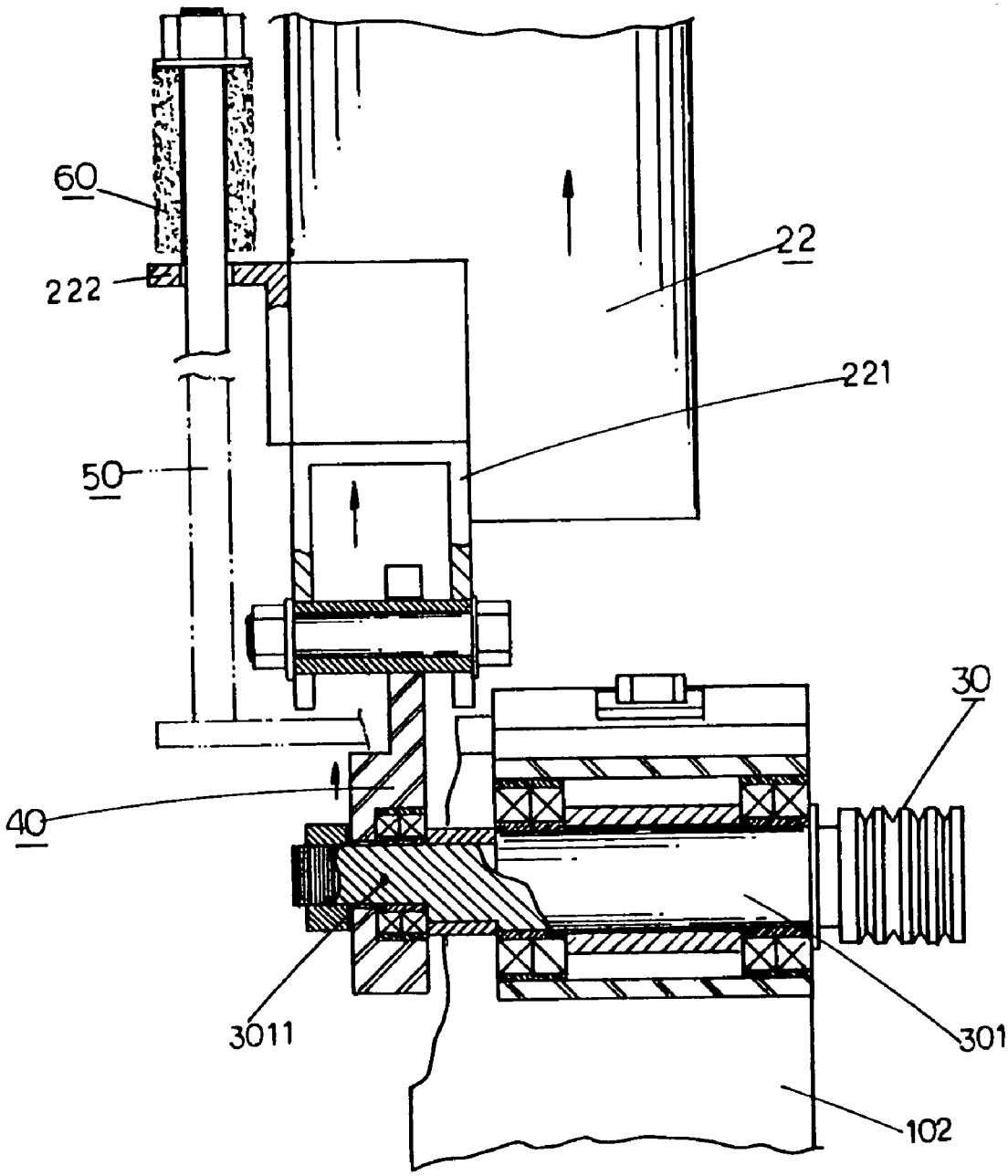
FIG. 4 is a schematic planar view of swinging a link rod upward and pushing a saddle support rod to shift upward according to the present invention.
Figure 5:
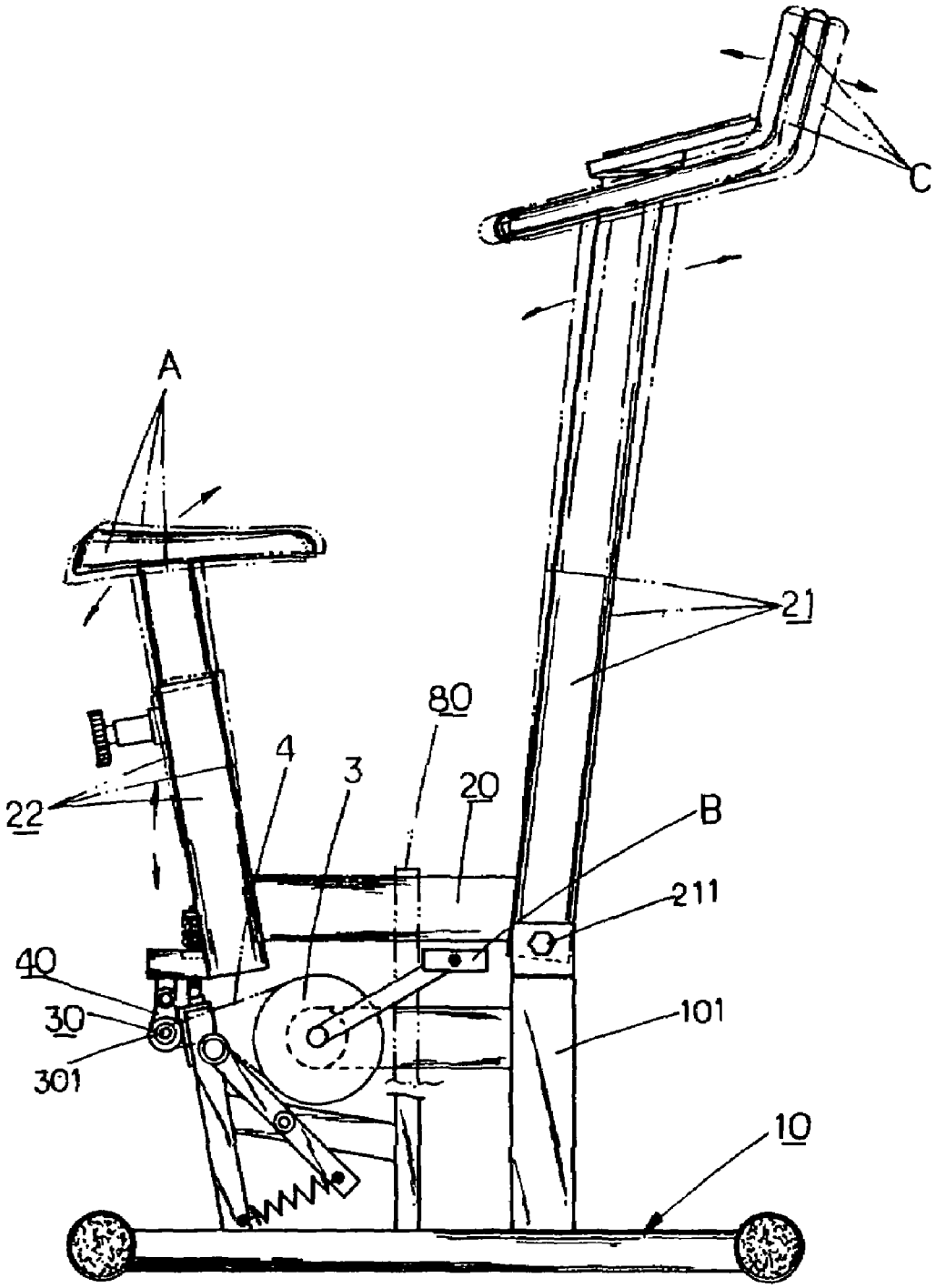
FIG. 5 is a schematic planar view of stepping on pedals for exercise according to the present invention.
Figure 6:
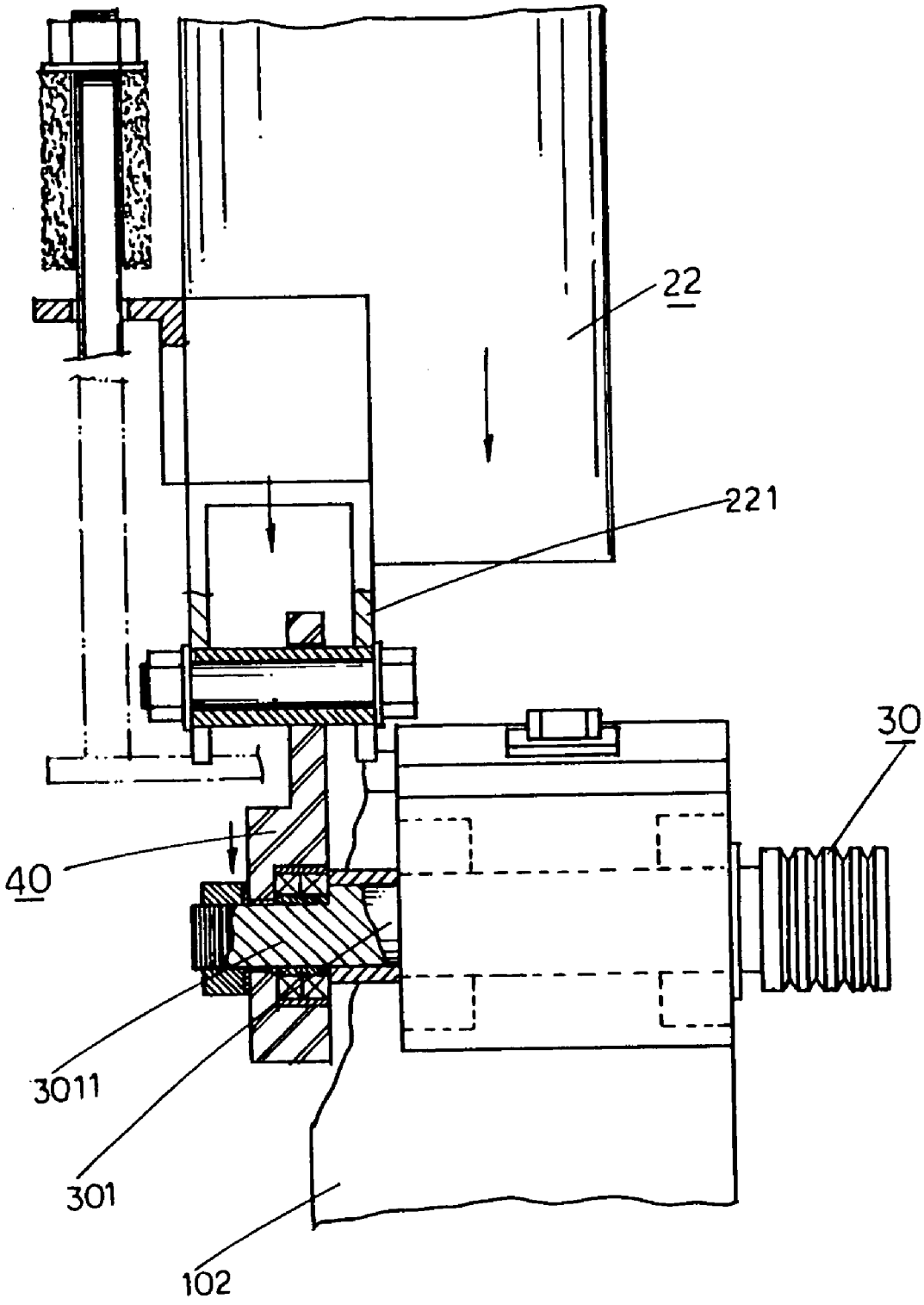
FIG. 6 is a schematic planar view of swinging a link rod downward and pushing a saddle support rod to shift downward according to the present invention.

Referring to the foregoing components of the present invention and FIGS. 5 and 6, the lower end of the handle support rod 211 at the front end of the transversal rod 20 is pivotally coupled and moved back and forth at first support rod 101 of the base, and the lower end of the saddle support rod 22 at the rear end of the transversal rod 20 is linked to the eccentric portion 3011 of the axle 301 of the passive pulley 30 through the link rod 40. When an exerciser sits on the saddle A and steps on the pedal B to turn the active pulley 3 and the active pulley 3 transmits the driving force to the passive pulley 30 and its axle 301 through the transmission belt 4, the link rod 40 will be driven directly by the eccentric portion 3011 of the axle 301 of the passive pulley 30 to swing vertically up and down as shown in FIGS. 4 and 6, and the saddle support rod 22 together with the saddle A are also driven to swing vertically up and down continuously. While the saddle support rod 22 is swung up and down, the handle support rod 21 disposed at the corresponding end of the saddle support rod 22 also uses the fixing bolt 211 at a lower end as a pivot to swing back and forth, such that the handle C at an upper end produces continuous back and forth vibrations. Therefore, the exerciser can step on the pedal B for exercising both legs and the saddle A and the handle C also produces continuous vibration while the exercisers steps on the paddles to produce vibration and shaking movements, so as to produce an amazing comfortable massaging effect for exercising the whole body including both arms.

Since the lower end of the saddle support rod 22 and the eccentric portion 3011 of the axle 301 of the passive pulley 30 are linked by the link rod 40, therefore when the exerciser leans forward to step on the pedal B and applies a force to the handle C, the saddle support rod 22 will not be soared up in the air at all, but the saddle support rod 22 will remain vibrating with the handle support rod 21.

If the saddle support rod 22 together with the transversal rod 20 and the handle support rod 21 produce the up-and-down and back-and-forth vibrations and shaking movements, the vibration and shaking movements will be stable and will not be moved sideway since a holding rod 80 is disposed separately on both sides of the transversal rod 20.

Figure 7:
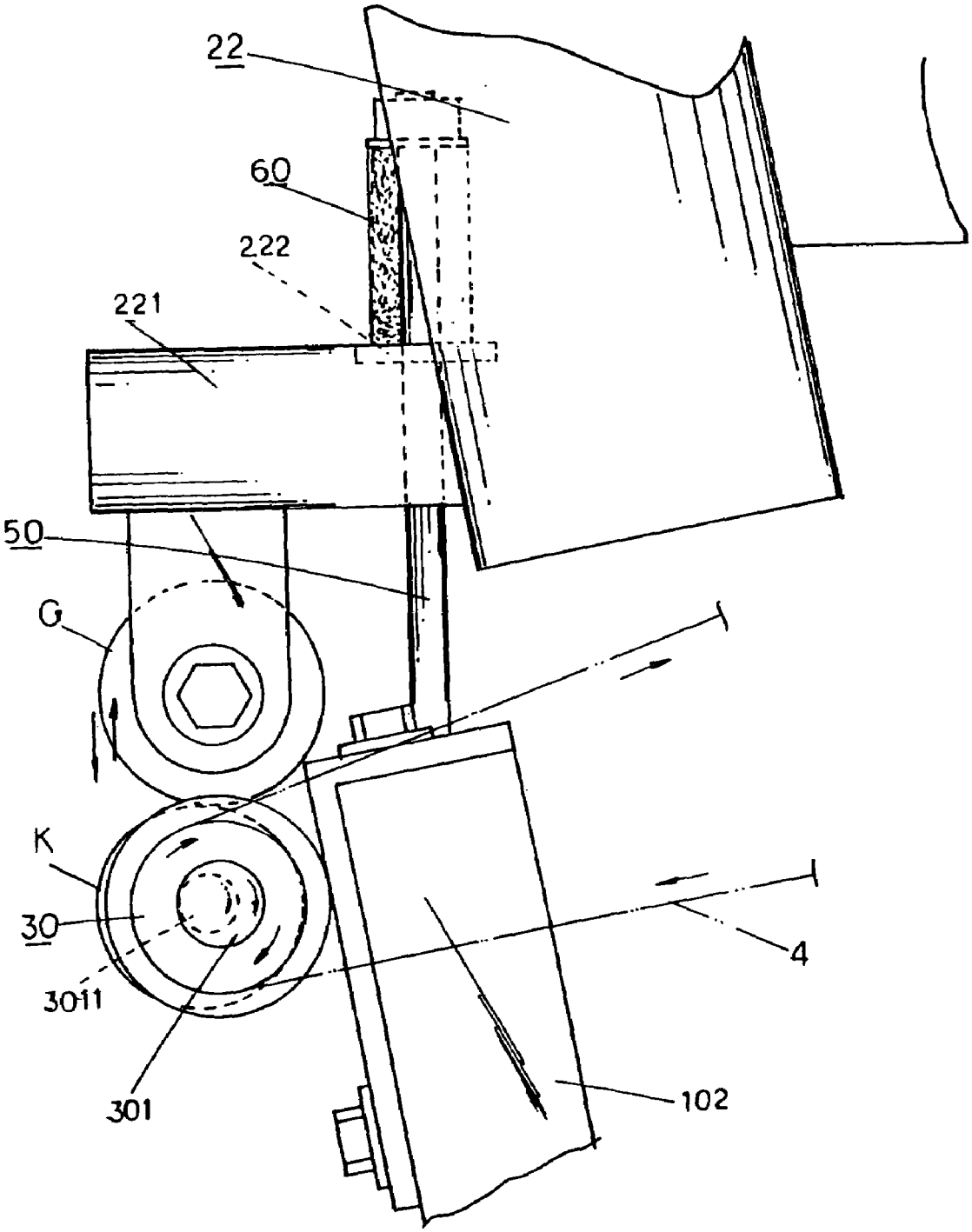
FIG. 7 is a schematic planar view of installing a rolling wheel separately to a saddle support rod and a passive pulley axle according to another preferred embodiment of the present invention.

Referring to FIG. 7 of the schematic view of another preferred embodiment of the present invention, a rolling wheel K, G is installed separately at the eccentric portion 3011 of the axle 301 of the passive pulley 30 and the driving stand 221 at the lower end of the saddle support rod 22 to substitute the foregoing link rod 40, such that when an exerciser sits on the saddle A and uses both hands to hold the handle C and step on the pedal B, the rolling wheels G, K will be in contact with each other due to the exerciser's body weight, and the rolling wheel K on the eccentric portion 3011 of the axle 301 of the passive pulley 30 will be rotated to move up and down as the passive pulley 30 rotates, and the rolling wheel G with the saddle support rod 22 is driven to move up and down as well. As a result, the saddle A together with the handle C will produce continuous vibrations and shaking movements automatically as described above, while providing the effects of exercising both legs and massaging the whole body for the users. Of course, a buffer member 60 can be installed onto a limit rod 50 of the base 10, after the limit rod 50 passes through the fastening protrusion 222 of the saddle support rod 22, the rolling wheel G on the driving stand 221 can be elastically in contact with the corresponding rolling wheel K. When the exerciser steps on the pedal B for doing exercises, the two rolling wheels G, K will not produce a bouncing phenomenon, and the saddle A and the handle C continue vibrating and shaking the exerciser so as to provide the expected comfortable exercising effects.

In summation of the above description, the improved fitness bike of the present invention not only has innovative improvements on its space configuration, but also maximizes the performance and enhances the performance than the conventional structure and further complies with the patent application requirements.

While the invention has been described by means of specific embodiments, numerous modifications and variations could be made thereto by those skilled in the art without departing from the scope and spirit of the invention set forth in the claims.

What is claimed is:

1. An improved fitness bike, comprising:

a base including a first support rod disposed proximate to a front end thereof;

a handle support rod pivotally coupled to said first support rod and movable back and forth at an upper end thereof, said handle support rod having a handle at said upper end;

a second support rod disposed proximate to a rear end of said base, said second support having a passive pulley disposed at an upper end thereof;

a bottom bracket shell disposed between said first support rod and said second support rod by a support arm;

an active pulley disposed at said bottom bracket shell and having left and right cranks with the same axis, each said left and right cranks respectively having a pedal at an end thereof;

a transmission belt disposed between said active pulley and said passive pulley, said passive pulley having axle;

a transverse rod coupled to said handle support rod and a saddle support rod at front and rear ends respectively, said saddle support rod having a saddle at an upper end thereof;

a driving stand installed at a lower end of said saddle support rod; and a link rod disposed between said driving stand and said axle of the passive pulley, whereby when an exerciser steps on said pedal, said active pulley transmits a driving force to said passive pulley, said link rod on said axle of said passive pulley drives said saddle support rod to move up and down, and said saddle support rod, said saddle, said transverse rod, said handle support rod, and said handle simultaneously produce continuous up-and-down and back-and-forth vibrations and shaking movements.

2. The improved fitness bike of claim 1, wherein said base further comprises two holding rods extending longitudinally to said transverse rod.

3. An improved fitness bike, comprising:

a base including a first support rod disposed proximate to a front end thereof; a saddle support rod a handle support rod pivotally coupled to said first support rod and movable back and forth at an upper end thereof, said handle support rod having a handle at said upper end;

a second support rod disposed proximate to a rear end of said base, said second support rod having a passive pulley disposed at an upper end thereof;

a bottom bracket shell disposed between said first support rod and said second support rod by a support arm;

an active pulley disposed at said bottom bracket shell and having left and right cranks with the same axis, each said left and right cranks respectively having a pedal at an end thereof;

a transmission belt disposed between said active pulley and said passive pulley, said passive pulley having an axle;

a transverse rod coupled to said handle support rod and said saddle support rod at the front and rear ends respectively;

a fastening protrusion and a driving stand installed at a lower end of said saddle support rod, said saddle support rod having a saddle at an upper end thereof;

a rolling wheel installed in contact with said driving stand and said axle of said passive pulley respectively;

a limit rod disposed at said base; and a buffer member disposed at said lower end of said saddle support rod, whereby when an exerciser steps on said pedal, said active pulley transmits driving force to said passive pulley and drives said rolling wheel on said axle of said passive pulley to move said rolling wheel at the lower end of said saddle support rod to move up and down, and said saddle support rod, said saddle, said transverse rod, said handle support rod, and said handle to produce continuous up-and-down and back-and forth vibrations and shaking movements.

4. The improved fitness bike of claim 3, wherein said base further comprises two holding rods extending longitudinally to said transverse rod.

* * * * *